US006767056B2

(12) United States Patent
Tseng

(10) Patent No.: US 6,767,056 B2
(45) Date of Patent: Jul. 27, 2004

(54) SETTEE WITH A FOLDABLE TRAY-SUPPORT UNIT

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 75 days.

(21) Appl. No.: 10/046,368

(22) Filed: Jan. 14, 2002

(65) Prior Publication Data

US 2003/0132648 A1 Jul. 17, 2003

(51) Int. Cl.[7] ..... A47C 15/00
(52) U.S. Cl. ..... 297/248; 297/281; 297/188.21
(58) Field of Search ..... 297/112, 113, 297/114, 188.01, 188.21, 232, 257, 248, 273, 277, 281, 135, 173, 170; 108/44; 472/118, 125

(56) References Cited

U.S. PATENT DOCUMENTS 2,547,891 A * 4/1951 Smith
2,824,599 A * 2/1958 Quinlan
4,533,175 A * 8/1985 Brennan ..... 297/232
5,303,976 A * 4/1994 Nobile et al. ..... 297/232 X
5,433,503 A * 7/1995 De Filippo ..... 297/115
5,516,191 A * 5/1996 McKee ..... 297/188.15
5,788,324 A * 8/1998 Shea et al. ..... 297/188.04 X
5,947,554 A * 9/1999 Mashkevich ..... 297/115
6,585,319 B2 * 7/2003 Tseng ..... 297/281

* cited by examiner

*Primary Examiner*—Peter M. Cuomo
*Assistant Examiner*—Stephen Vu
(74) *Attorney, Agent, or Firm*—Ladas & Parry

(57) ABSTRACT

A settee includes an elongated seat unit and a tray-support unit. The seat unit includes a seat frame having opposing front and rear frame portions, and a backrest frame which extends uprightly from the rear frame portion and which defines a tray-accommodating space. The tray-support unit includes a tray-support frame that has a lower frame section with a rear end pivoted to the rear frame portion of the seat frame in such a manner that the tray-support frame is rotatable relative to the seat frame between a storing position, in which, the tray-support frame is turned to and retained within the tray-accommodating space, and a used position, in which, the front end of the tray-support frame is seated on the seat frame.

5 Claims, 8 Drawing Sheets

SETTEE WITH A FOLDABLE TRAY-SUPPORT UNIT

BACKGROUND OF THE INVENTION

1. Field of the Invention

The present invention relates to a settee, more particularly to a settee with a foldable tray-support unit.

2. Description of the Related Art

Referring to FIG. 1, a conventional settee 1 is shown to include left and right seat supports 11, an elongated seat 12 disposed between the seat supports 11, two backrests 14 that extend upwardly from a rear side of the seat 12, and a table 15 mounted on the elongated seat 12 between the backrests 14. The aforesaid conventional settee 1 is disadvantageous in that the table 15 cannot be folded relative to the seat 12, thereby restricting the utility of the conventional settee 1.

SUMMARY OF THE INVENTION

The object of the present invention is to provide a settee with a foldable tray-support unit so as to enhance flexibility of the settee during use.

Accordingly, a settee of the present invention includes an elongated seat unit and a tray-support unit. The seat unit includes a seat frame having opposing front and rear frame portions, and a backrest frame which extends uprightly from the rear frame portion and which defines a tray-accommodating space. The tray-support unit includes a tray-support frame that has a lower frame section with a front end and a rear end opposite to the front end and pivoted to the rear frame portion of the seat frame in such a manner that the tray-support frame is rotatable relative to the seat frame between a storing position, in which, the front end of the tray-support frame is turned to and retained within the tray-accommodating space, and a used position, in which, the front end of the tray-support frame is seated on the seat frame.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
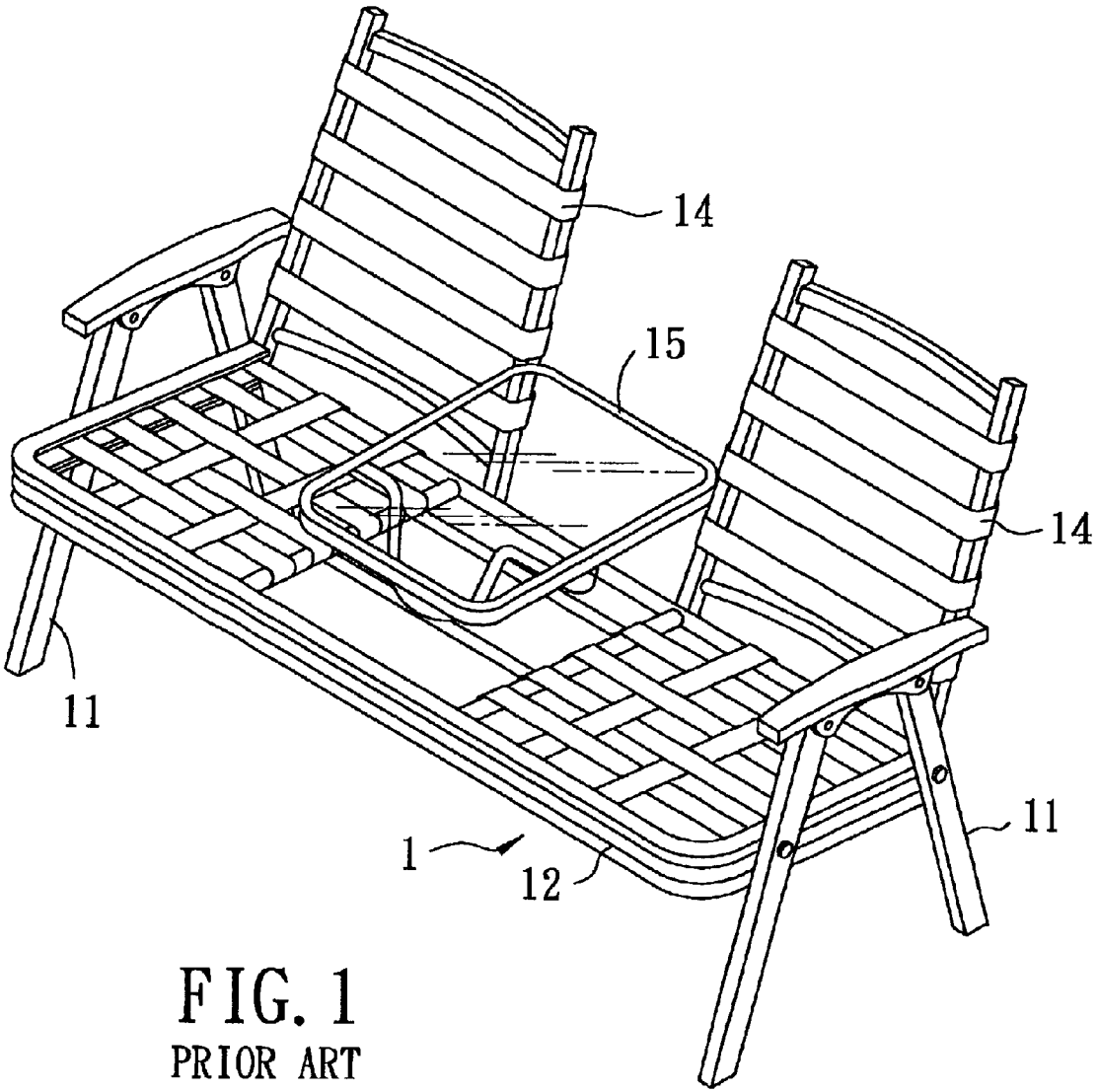
FIG. 1 PRIOR ART
FIG. 1 is a perspective view of a conventional settee.
Figure 2:
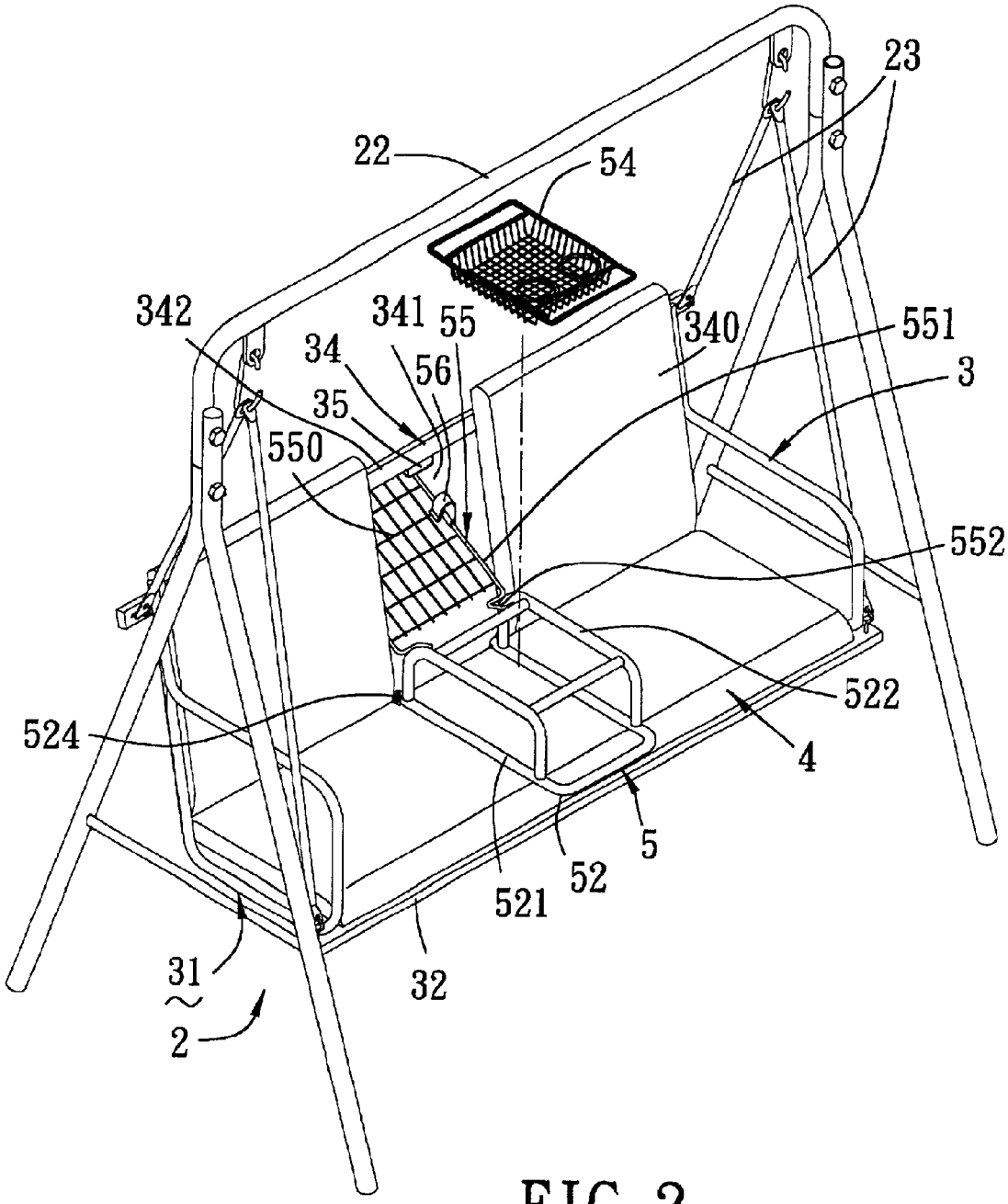
FIG. 2 is a perspective view of a preferred embodiment of a settee according to the present invention, with a tray removed therefrom.
Figure 3:
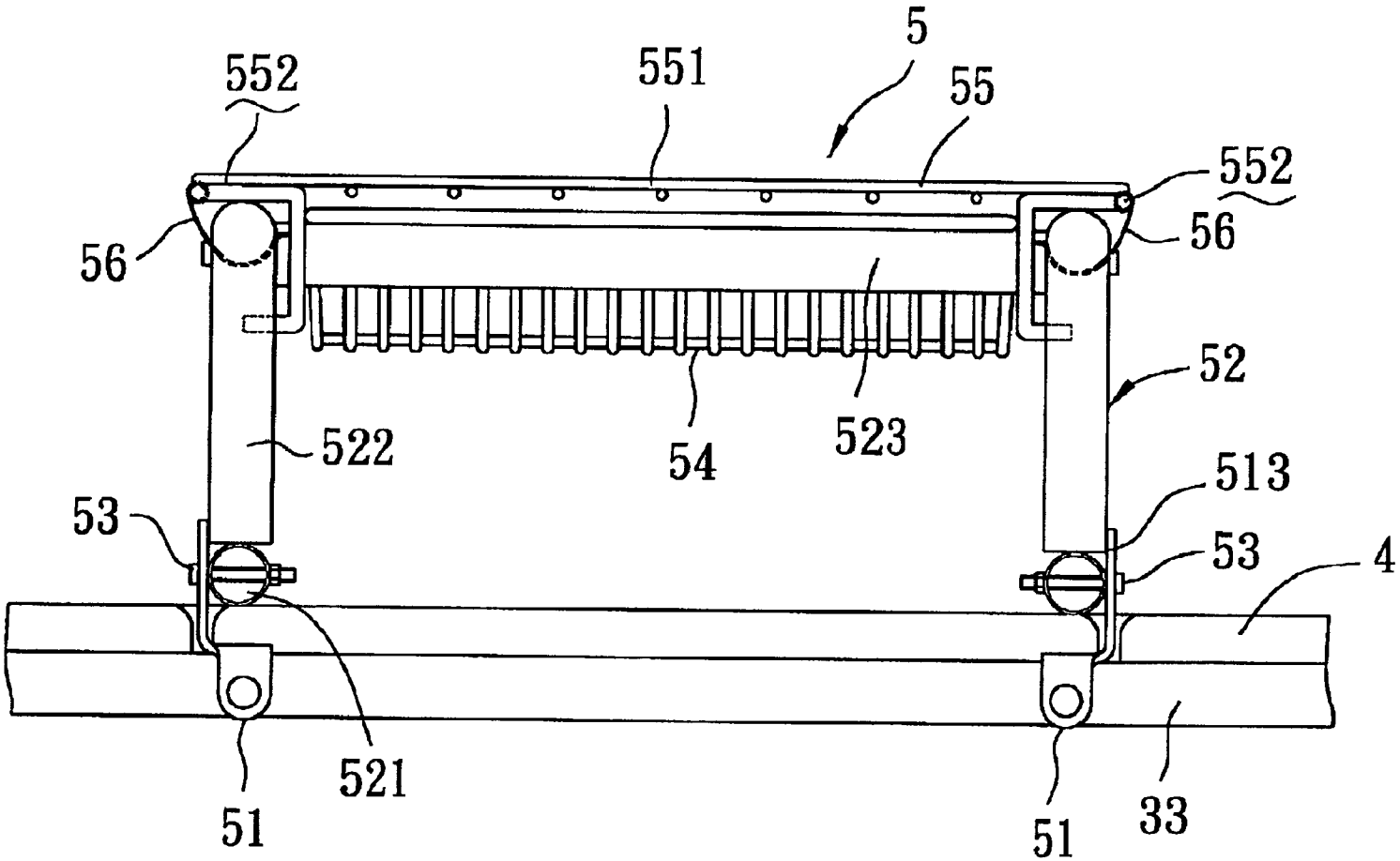
FIG. 3 is a fragmentary rear view of the preferred embodiment shown in FIG. 2.
Figure 4:
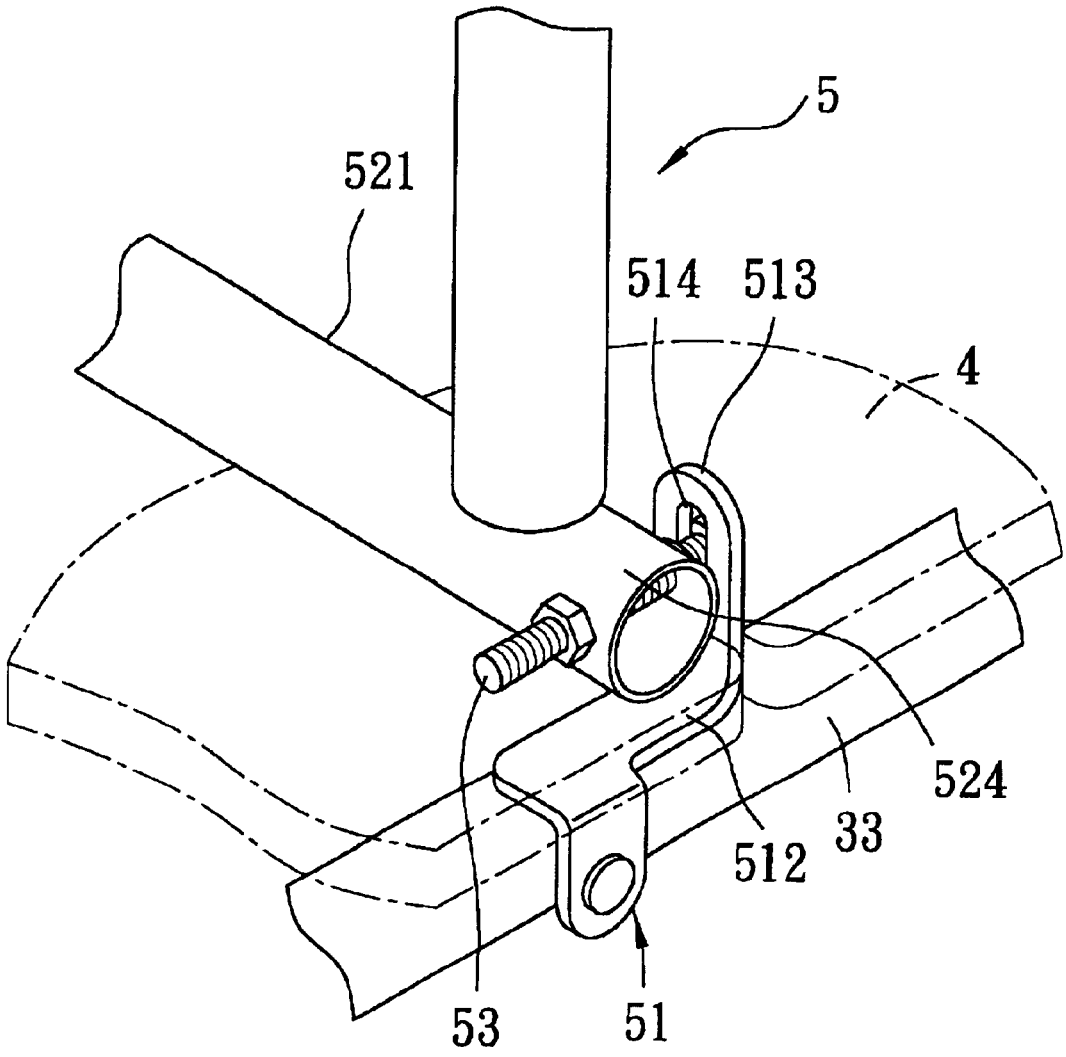
FIG. 4 is a fragmentary bottom perspective view of the preferred embodiment shown in FIG. 2, illustrating how a tray-support frame is mounted on a seat frame and its relation with a seat plate.

Before the present invention is described in greater detail with reference to the following preferred embodiments, it should be noted that same reference numerals have been used to denote similar elements throughout the specification.

Referring to FIGS. 1 to 4, a preferred embodiment of a settee according to the present invention is shown to include an elongated seat unit 3 and a tray-support unit 5.

As illustrated, the seat unit 3 includes a seat frame 31 having opposing front and rear frame portions 32,33, and a backrest frame 34 which extends uprightly from the rear frame portion 33 and which defines two backrest supports 340 and a frame-accommodating space 341 located between and rearwardly of the backrest supports 340.

Figure 5:
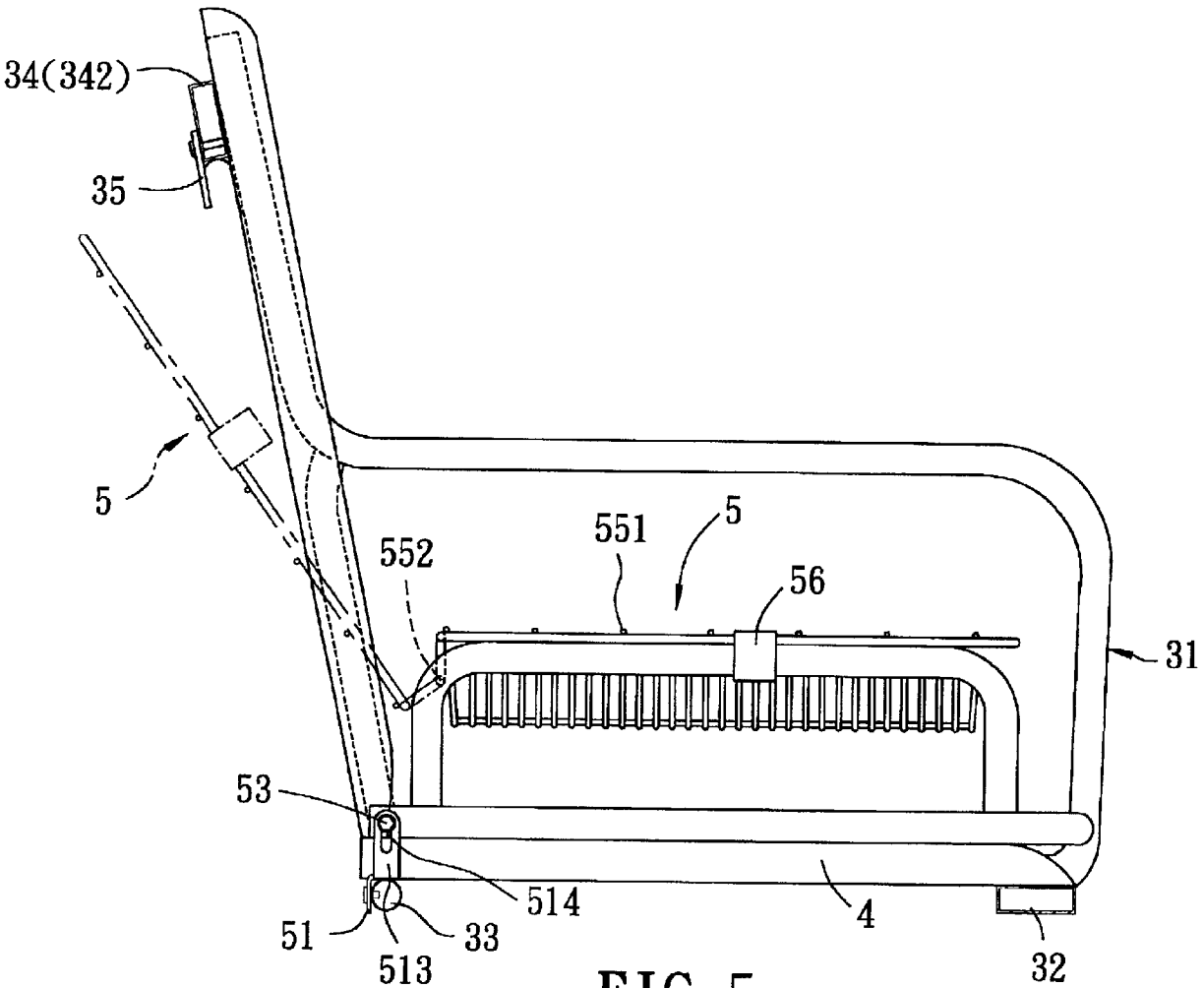
FIG. 5 is a schematic side view of the preferred embodiment shown in FIG. 2 with two seat supports removed therefrom, illustrating how a tray cover is mounted on the tray-support unit.
Figure 6:
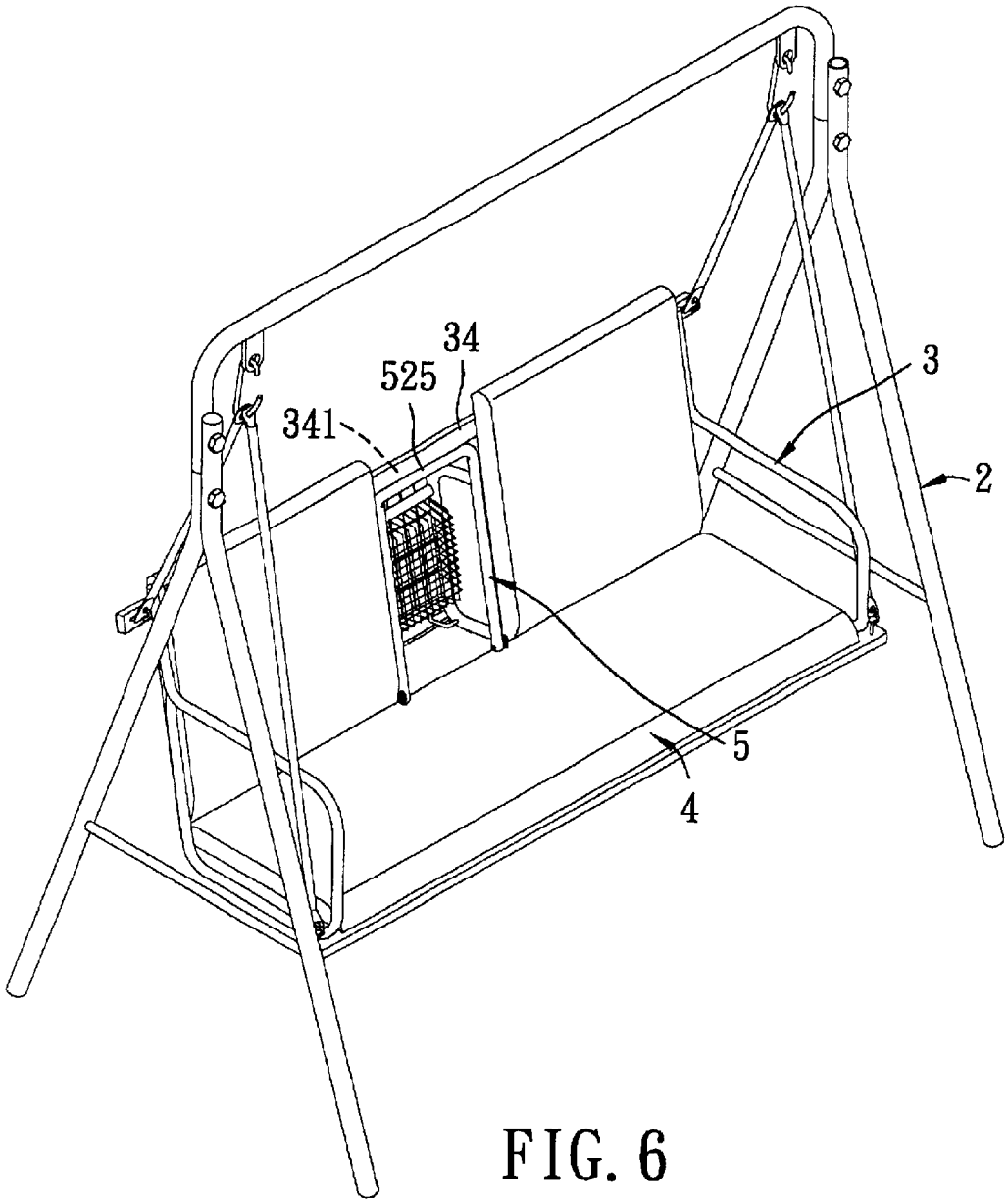
FIG. 6 is a perspective view of the preferred embodiment with the tray-support unit folded on a backrest frame.

The tray-support unit 5 includes a tray-support frame 52 that has a lower frame section 521 with a front end 525 and a rear end 524 opposite to the front end 525 and pivoted to the rear frame portion 33 of the seat frame 31 in such a manner that the tray-support frame 52 is rotatable relative to the seat frame 31 between a storing position, in which, the front end of the tray-support frame 52 is turned to and retained within the tray-accommodating space 341, as best shown in FIG. 6, and a used position, in which, the front end of the tray-support frame 52 is seated on the seat frame 31, as best shown in FIG. 5.

Figure 7:
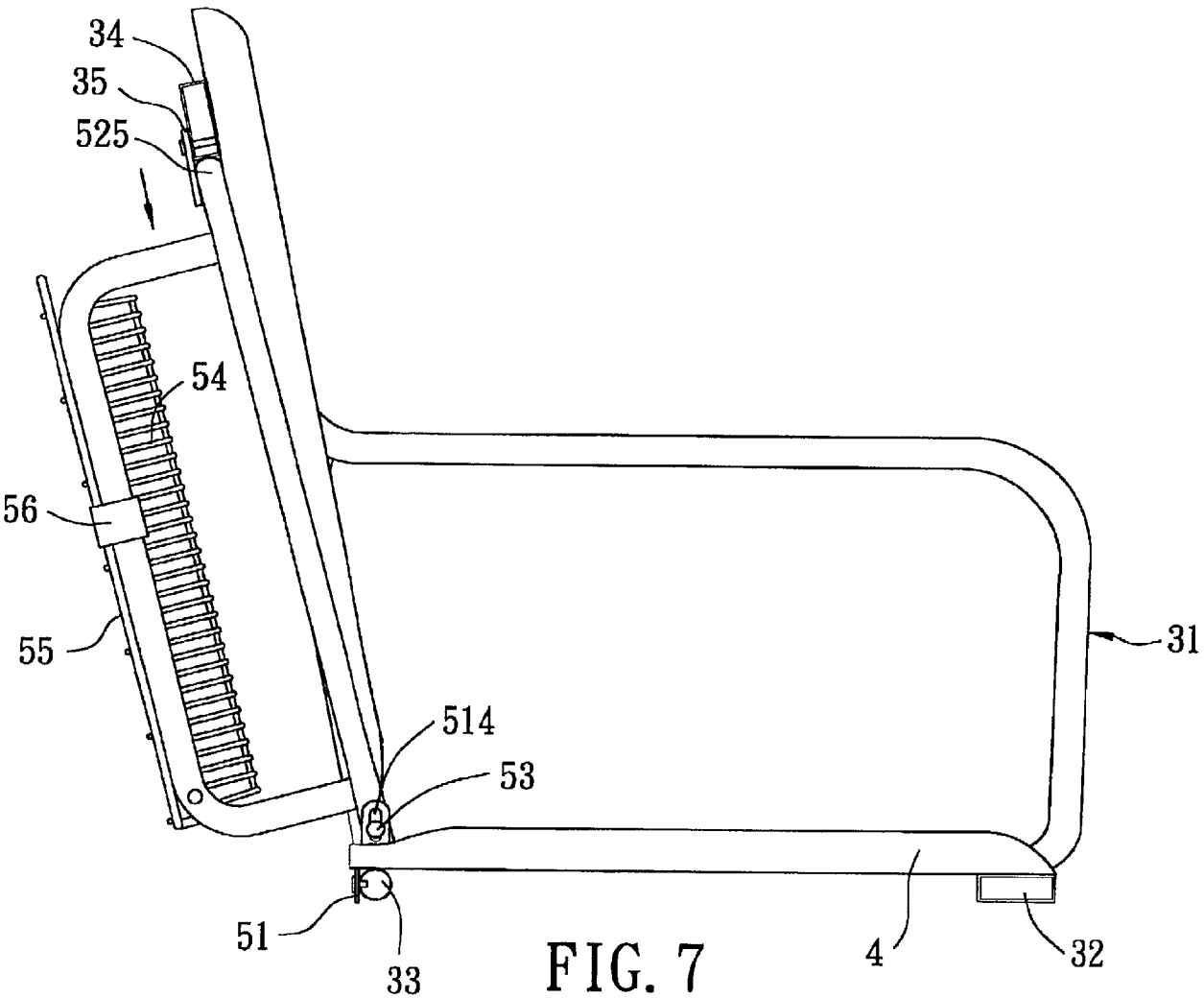
FIG. 7 is a view similar to FIG. 5 but with the tray-support unit folded on the backrest frame.

The tray-support unit 5 includes a pivot plate 51 having a horizontal plate section 512 fixed on the rear frame portion 33 of the seat frame 31, a vertical plate section 513 which extends upwardly from the horizontal plate section 512 and which is formed with a vertical slot 514, and a pivot pin 53 that extends through the vertical slot 514 and the rear end 524 of the lower frame section 521 of the tray-support frame 52. The pivot pin 53 is movable upwardly and downwardly along the length of the vertical slot 514 so as to permit the tray-support frame 52 to be seated evenly on the seat plate 4. When the tray-support frame 52 is turned to the storing position, as best shown in FIG. 7, the pivot pin 53 moves in the vertical slot 514 toward the rear frame portion 33 of the seat frame 31 due to absence of the seat plate 4 on the rear frame portion 33.

The backrest frame 34 has an upper cross-bar 342 and a positioning member 35 mounted on the upper cross-bar 342. The front end 525 of the lower frame section 521 of the tray-support frame 52 releasably engages the positioning member 35 so as to retain the tray-support frame 52 at the storing position (see FIG. 6).

The tray support unit 5 further includes a tray 54 seated on the tray-support frame 52, and a tray cover 55 pivoted on the tray-support frame 52 so as be movable, when the tray-support frame 52 is disposed at the used position, between a covering position, in which, the tray cover 55 conceals and covers the tray 54 underneath, as shown by solid lines in FIG. 5, and a non-covering position, in which, the tray cover 55 is turned to and is retained in the frame-accommodating space 341, as shown by dotted lines in FIG. 5, thereby exposing the tray 54 so as to be accessible from an exterior of the tray-support frame 52.

The tray-support frame 52 has an upper frame section in the form of spaced apart inverted U-shaped frame parts 522 which are fixed on the lower frame section 521 and which extend between the front and rear frame portions 32,33 of the seat frame 31. The tray 54 is seated between the inverted U-shaped frame parts 522. The tray cover 55, preferably, includes a net 550 disposed over the inverted U-shaped frame parts 552, a U-shaped rod unit 551 surrounding the net 550, and a pair of U-shaped rod sections 552 which extend integrally from the rod unit 551 and which are pivoted to the inverted U-shaped frame parts 552 in such a manner that the U-shaped rod sections 552 rest on rear ends of the U-shaped frame parts 552 when the tray cover 55 is positioned at the non-covering position (shown by dotted lines in FIG. 5).

The tray-support unit 5 further includes a fastener clasp 56 which is mounted on the rod unit 551 of the tray cover 55 and which releasably engages one of the inverted U-shaped frame parts 522 so as to prevent untimely movement of the tray cover 55 relative to the inverted U-shaped frame parts 522 from the covering position to the non-covering position when the tray-support frame 52 is disposed at the used position.

The preferred embodiment further includes left and right seat supports 2 between which the elongated seat unit 3 is disposed, and a connecting frame 22 that is disposed above the seat unit 3 and that interconnects upper ends of the left and right seat supports 2. The seat unit 3 is mounted swingeably to the connecting frame 22 via two pairs of suspension rods 23 (see FIG. 2), such that the entire assembly can serve as a swing.

Figure 8:
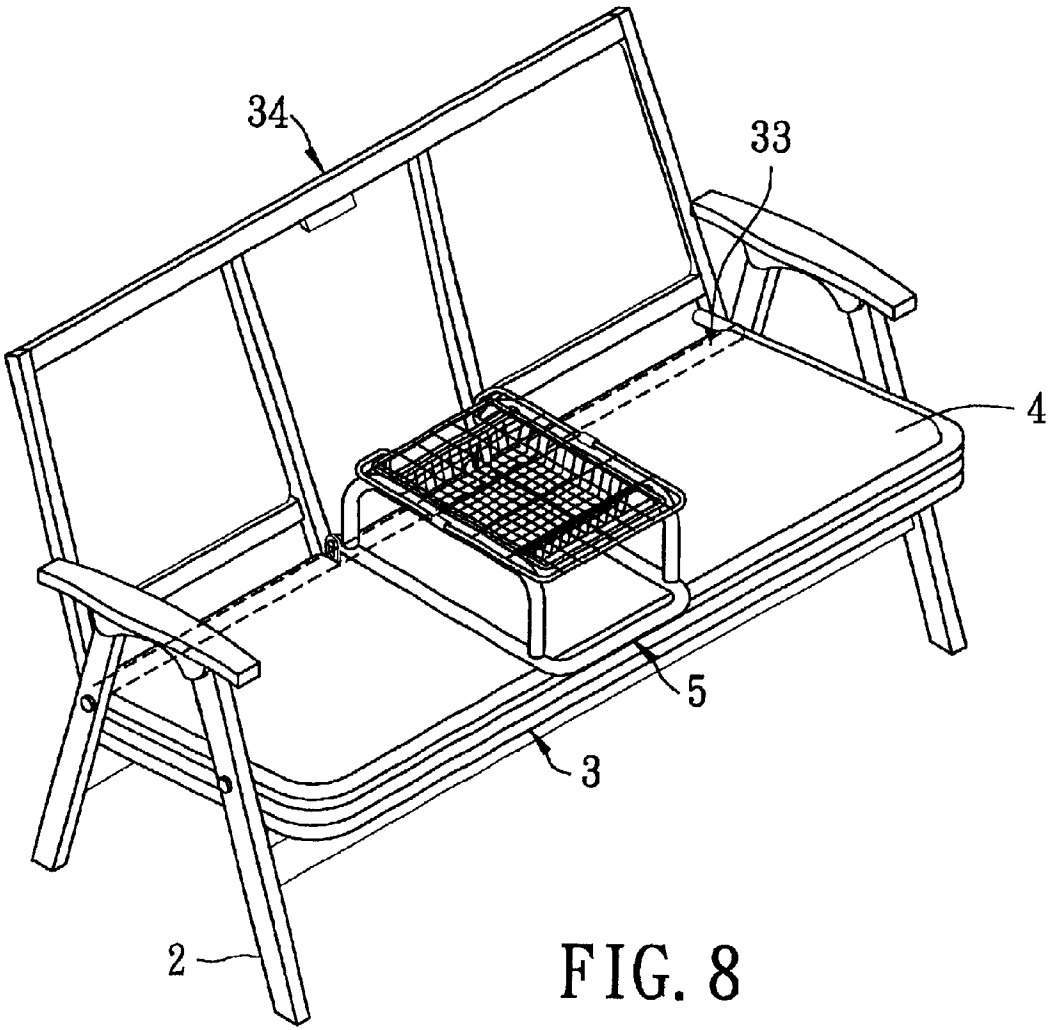
FIG. 8 is a perspective view of a modified preferred embodiment of the present invention.

Referring to FIG. 8, a modified preferred embodiment of the present invention is shown to have a structure similar to that of the previous embodiment. The main difference resides in that left and right seat supports 2 sandwich the seat unit 3 therebetween and that two opposite sides of the seat unit 3 are fastened securely to intermediate sections of the seat supports 2 via fastener devices.

While the present invention has been described in connection with what is considered the most practical and preferred embodiments, it is understood that the present invention is not limited to the disclosed embodiments but is intended to cover various arrangements included within the spirit and scope of the broadest interpretation so as to encompass all such modifications and equivalent arrangements.

I claim:

1. A settee comprising:

an elongated seat unit including a seat frame having opposing front and rear frame portions, and a backrest frame which extends uprightly from said rear frame portion and which defines a tray-accommodating space; and a tray-support unit including a tray-support frame that has a lower frame section with a front end and a rear end opposite to said front end and pivoted to said rear frame portion of said seat frame in such a manner that said tray-support frame is rotatable relative to said seat frame between a storing position, in which, said front end of said tray-support frame is turned to and retained within said tray-accommodating space, and a used position, in which, said front end of said tray-support frame is seated on said seat frame;

wherein said tray-support unit further includes a pivot plate which extends upwardly from said rear frame portion of said seat frame and which is formed with a vertical slot, and a pivot pin that extends through said vertical slot and said rear end of said lower frame section of said tray-support frame, said pivot pin being movable upwardly end downwardly along the length of said vertical slot to permit said tray-support frame to be seated evenly on said seat frame;

wherein said backrest frame has an upper cross-bar and a positioning member mounted on said upper cross-bar, said front end of said lower frame section of said tray-support frame releasably engaging said positioning member so as to be retained at said storing position.

2. The settee as defined in claim 1, wherein said tray support unit further includes a tray seated on said tray-support frame, and a tray cover pivoted on said tray-support frame so as be movable, when said tray-support frame is disposed at said used position, between a covering position. In which, sold tray cover conceals said tray underneath, and a non-covering position. In which, said tray cover is turned to and is retained in said tray-accommodating space, thereby exposing said tray so as to be accessible from an exterior of said tray-support frame.

3. The settee as defined in claim 2, wherein said tray-support frame has an upper frame section in the form of spaced apart inverted U-shaped frame parts fixed on said lower frame section and extending between said front and rear frame portions of said seat frame, said tray being seated between said inverted U-shaped frame parts, said tray cover including a net disposed over said inverted U-shaped frame parts, a U-shaped rod unit surrounding said net, and a pair of U-shaped rod sections extending integrally from said rod unit and pivoted to said inverted U-shaped frame parts in such a manner that said U-shaped rod sections rest on rear ends of said U-shaped frame part when said tray cover is positioned at said non-covering position.

4. The settee as defined in claim 3, wherein said tray-support unit further includes a fastener clasp mounted on said rod unit of said tray cover and adapted to detachably engage one of said inverted U-shaped frame parts so as to prevent untimely movement of said tray cover relative to said tray-support frame from said covering position to said non-covering position when said tray-support frame is disposed at said used position.

5. The settee as defined in claim 4, further comprising left and right seat supports between which said elongated seat unit is disposed, and a connecting frame disposed above said seat unit and interconnecting upper ends of said left and right seat supports, said seat unit being mounted swingeably on said connecting frame.

* * * * *